US005501295A

United States Patent [19]

Müller et al.

[11] Patent Number: 5,501,295

[45] Date of Patent: Mar. 26, 1996

[54] CABLELESS ELEVATOR SYSTEM

[75] Inventors: Wolfgang Müller, Meggen; Viktor Wunderlin, Kriens, both of Switzerland

[73] Assignee: Inventio AG, Hergiswil, Switzerland

[21] Appl. No.: 18,787

[22] Filed: Feb. 17, 1993

[30] Foreign Application Priority Data

Feb. 17, 1992 [CH] Switzerland ..... 00463/92

[51] Int. Cl.[6] ..... B66B 9/00

[52] U.S. Cl. ..... 187/406; 414/279; 187/403

[58] Field of Search ..... 187/16, 1 R, 112, 187/95; 414/279, 592; 104/131, 127, 129

[56] References Cited

U.S. PATENT DOCUMENTS

| | | | |
|---|---|---|---|
| 2,052,690 | 9/1936 | Austin | 187/16 |
| 3,658,155 | 4/1972 | Salter | 187/16 |
| 4,459,078 | 7/1984 | Chiantella et al. | 414/279 |
| 5,090,515 | 2/1992 | Takahashi et al. | 187/16 |
| 5,238,348 | 8/1993 | Reimer | 414/279 |

FOREIGN PATENT DOCUMENTS

| | | | |
|---|---|---|---|
| 1251925 | 10/1967 | Germany . | |
| 1912520 | 9/1970 | Germany . | |
| 2232739 | 1/1973 | Germany . | |
| 2154923 | 5/1973 | Germany . | |
| 4169489 | 6/1992 | Japan | 187/112 |

*Primary Examiner*—Kenneth W. Noland
*Attorney, Agent, or Firm*—Howard & Howard

[57] ABSTRACT

A cableless elevator system for very high buildings includes several vertical travel shafts with apparatus at the floors for horizontal travel of the elevator cars between shafts. Several cars can move in the same shaft at the same time. Vertically extending shaft wall strips positioned between the shafts have horizontal guide channels and vertical rolling tracks formed therein. During vertical travel, upper and lower guide rollers on the cars engage the rolling tracks and the cars are moved by a combination of a linear drive and a friction drive. The friction drive utilizes battery powered electrical motors to drive the lower guide rollers. The linear drive has linear motor stators attached to the shaft rear wall and permanent magnets on the cars. During horizontal movement, the upper and lower guide rollers engage the horizontal guide channels and the lower rollers move the car. The vertical strips include pieces at the horizontal guide channels which close gaps in the rolling tracks during vertical movement of the cars and are pivoted to open the horizontal guide channels for horizontal movement of the cars.

19 Claims, 5 Drawing Sheets

CABLELESS ELEVATOR SYSTEM

BACKGROUND OF THE INVENTION

The present invention relates generally to an elevator system for high buildings and, in particular, to an apparatus for controlling the movement of a plurality of passenger carrying cars in and between a plurality of elevator shafts in a building.

There is a demand for a system of cable-free cars for the efficient transport of personnel in very high buildings. With such a system, it is possible to control the movement of several cars in the same shaft and thus increase the conveying capacity and correspondingly shorten the waiting times of the personnel. It is desirable in such systems that the cars move horizontally from one shaft into another at least at the lower and upper ends of the shafts. Such systems are shown in the prior art.

The German published patent specification 1 251 925 describes an elevator car which is guided and driven by rubber wheels running in the shaft corners. To reduce the required driving power, a counterweight is provided, which is likewise guided in rubber-tired wheels running in masonry grooves. The system is restricted to one car per shaft and no shaft change capability is provided.

The German published patent specification 2 154 923 describes a passenger elevator in which boarding and exiting places are provided beside tile travel shaft for different floors. A car can be pushed horizontally into these boarding and exiting places, for which co-moving guide rail pieces are replaced by additional pieces in order to close the gap in the guides and enable an overtaking of the stopping car by a moving car. The cars are individually powered and, in principle, more than one car can travel in the same shaft at the same time.

A similar system is described in the German published patent specification 1 912 520. However, a difference is that the cars are driven by a circulating cable.

A circulating transport device, in particular a loop-type elevator device, is described in the German published patent specification 2 232 739. Individually powered cars provided with linear drives can serve stopping places by changing over by way of resettable guide shunt switches from a traveling shaft into a stopping shaft. The system is constructed on the circulation principle with several cars in circulation at the same time.

An elevator system shown in the U.S. Pat. No. 3,658,155 includes several individually powered cars moving in two vertical shafts connected in a loop. The cars can move horizontally into boarding and exiting places in each shaft and change at the bottom and at the top from one shaft to another. A transverse shaft at the bottom of the vertical shafts provides a place for several cars to stop to load and unload passengers. The cars are driven by toothed wheels engaging a toothed rack in the shafts.

However, the above described systems do not provide a universal conveying system having the full freedom of movement of the individual cars everywhere along the travel path.

SUMMARY OF THE INVENTION

The present invention concerns a cableless elevator system for high buildings wherein several cars can move in the same shaft at the same time and change from shaft to shaft.

The elevator system includes an elevator car having a friction drive means attached thereto for moving along a vertical travel path in an elevator shaft and along an horizontal travel path extending from the elevator shaft, the friction drive means including front and rear upper guide rollers mounted on an upper wall of the car, front and rear lower guide rollers mounted on a lower wall of the car and lower and upper supporting rollers mounted on side walls of the car for engaging rolling tracks formed in the elevator shalt during the vertical travel of the car, and actuating, means attached to the car and connected to the supporting rollers for selectively moving the supporting rollers into and out of engagement with corresponding ones of the rolling tracks. The lower front and rear guide rollers each are rotatably mounted on an associated roller axle extending from an associated support attached to the lower wall of the car, each support including a direct current motor driving the associated axle coupled through a reduction gear, an eccentric bearing in which the associated axle is mounted, a worm wheel attached to the associated axle, a worm engaging the worm wheel and a servomotor driving the worm whereby the servomotor is selectively actuated to move the guide roller attached to the associated axle to increase contact pressure between the roller and a corresponding one of the rolling tracks and to level the elevator car at a floor served by the elevator shaft.

The system also includes a linear drive having a first portion mounted on the car and a second portion mounted in the elevator shaft for moving the car along the vertical travel path, and an horizontal guide means extending from the elevator shaft and forming the horizontal travel path for the car, the horizontal guide means including lower front and rear guide channels positioned at a level or a floor served by the elevator shaft and upper front and rear guide channels spaced above the lower front and rear guide channels, each of the guide channels having a pivotable intermediate piece for selectively closing and opening gaps in the elevator shaft along the vertical travel path for said elevator car. The first portion of the linear drive includes a plurality of linear motor stators mounted on a rear wall of the elevator shaft extending past several floors served by the elevator shalt, the stators being spaced apart between the floors, and including rear horizontal guide slides selectively extendable from the rear wall of the elevator shaft between the floors into the vertical path of travel of the car in the elevator shaft and front horizontal guide slides extendable from a front wall of the elevator shaft between the floors into the vertical path of travel of the car in the elevator shaft.

The present invention provides an elevator system in which cableless cars in several shafts have full freedom of movement between floors in vertical and horizontal directions.

The present invention also provides an elevator system with a combined drive in which the driving power is distributed between the car and the shaft. In the case of mains powers supply failure during vertical travel of the car, downward travel is slowed by the linear drive system and a fall is avoided by a mechanical braking device.

The advantages of the invention are that a new and more efficient traffic pattern can be realized by the complete freedom of movement of the individual cars, that fewer elevator shafts are necessary for the same capacity and that very great travel heights can be achieved through the omission of the cables.

Further advantages of the invention are that a power division is possible with two combined drive systems and that stopping cars are mechanically secured against downward travel.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
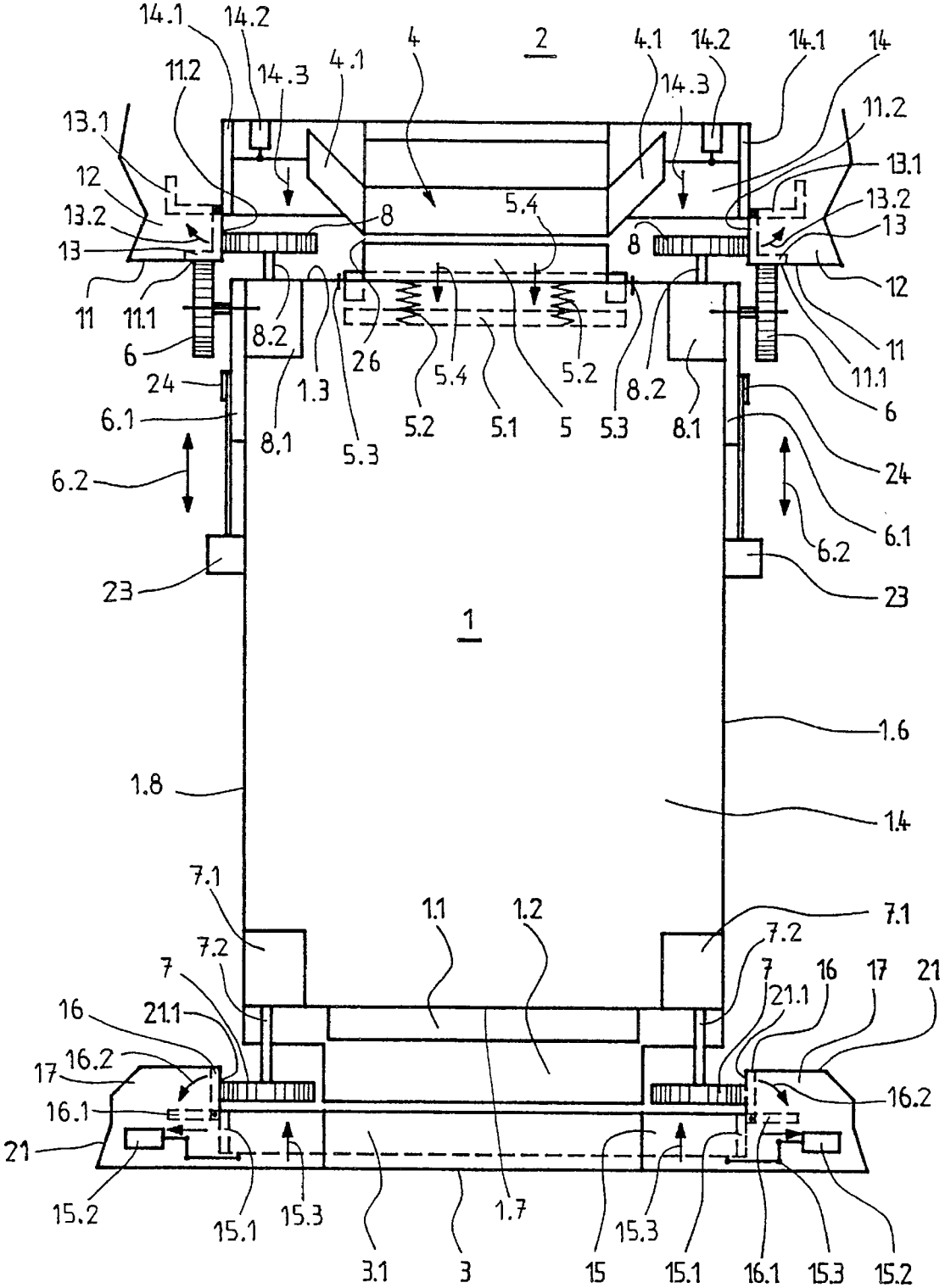
FIG. 1 is a top plan view of an elevator car and an elevator shaft of a cableless elevator system according to the present invention.
Figure 2:
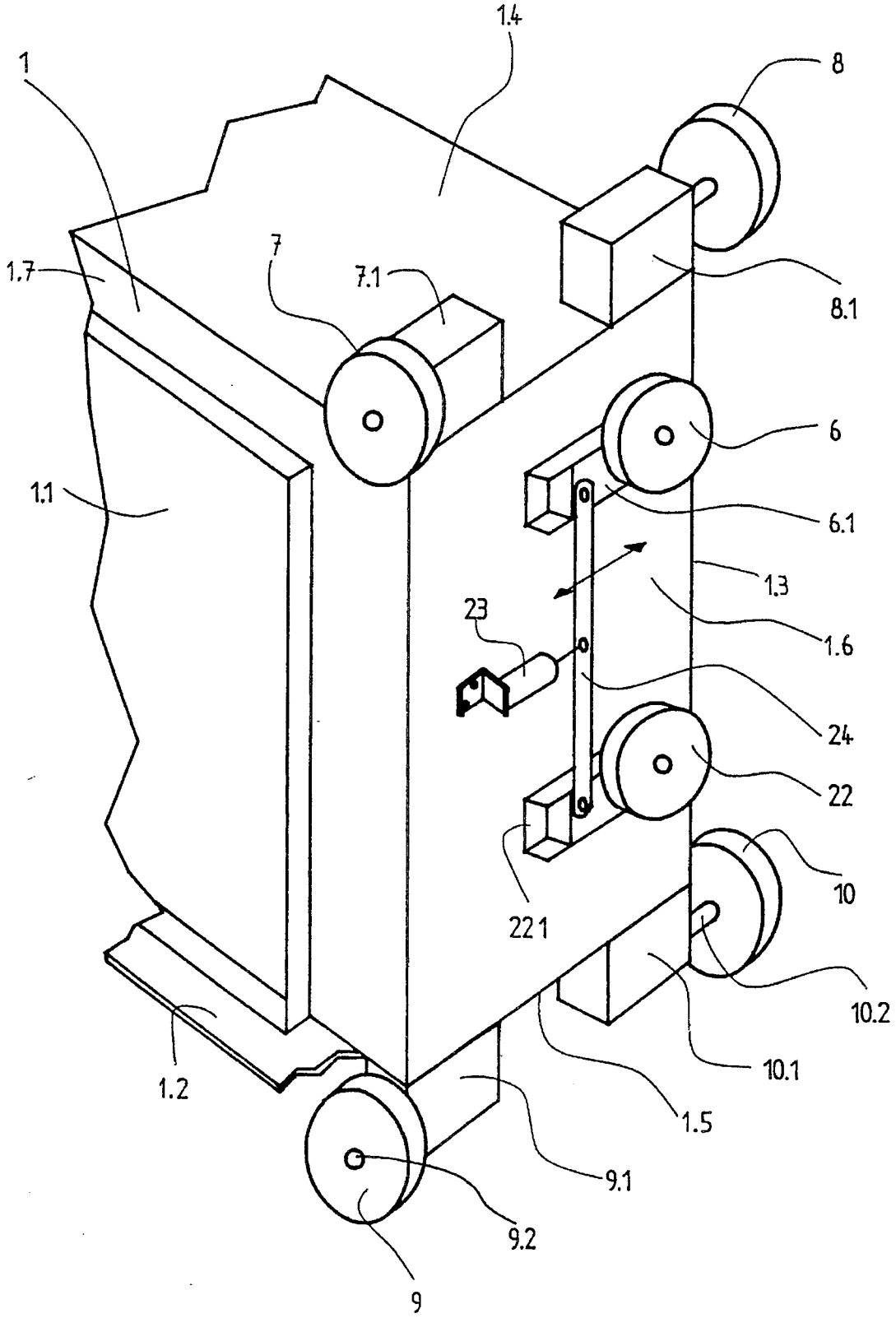
FIG. 2 is a fragmentary perspective view from a right side of the elevator car shown in the FIG. 1.

The FIG. 1 is a top plan view and the FIG. 2 is a fragmentary perspective view of a right side of a passenger conveying elevator car 1 having an entry opening 1.1 formed in a front wall above a car door threshold 1.2 extending outwardly from a lower front edge of the car. The car 1 is generally rectangular in shape with a rear wall 1.3, an upper or top wall 1.4, a lower or bottom wall 1.5, a right side wall 1.6, a front wall 1.7 and a left side wall 1.8 connected together to enclose the car. The car 1 is shown in the FIG. 1 positioned in a vertical elevator shaft between a vertically extending rear wall 2 and a vertically extending front wall 3. The car door opening 1.1 opens into a shaft door opening 3.1 formed in the shaft front wall 3 at a floor (not shown). A linear motor stator 4 having stator windings 4.1 is attached to the shaft rear wall 2. A generally horizontally extending permanent magnet 5 is mounted in a cavity 5.1 formed in the rear wall 1.3. The magnet 5 is held in the cavity 5.1 by a pair of return springs 5.2 which draw the magnet into the cavity in the direction shown by a pair of arrows 5.4. The magnet 5 is shown as being drawn out of the cavity 5.1 to a pair of lateral abutments 5.3 mounted on the car 1. As explained below, the magnet 5 is drawn out by an applied magnetic force. The magnet 5 is representative of one or more other such magnets vertically spaced along the rear wall 1.3.

As shown in the FIGS. 1 and 2, a pair of upper supporting rollers 6 are mounted on a pair of sliding supports 6.1, one roller and support attached to each of the side walls 1.6 and 1.8. Each of the supports 6.1 is attached adjacent an upper edge of the corresponding side wall and is horizontally movable toward the rear wall 1.3 and toward the front wall 1.7, as shown by arrows 6.2, by an associated one of a pair of vertically extending lever mechanisms 24. Each lever mechanism 24 has an upper end connected to the corresponding support 6.1 and a center portion connected to an associated one of a pair of actuating devices 23 each mounted on a corresponding one of the side walls 1.6 and 1.8. As shown in the FIG. 2, a lower supporting roller 22 is mounted on a sliding support 22.1 attached to the side wall 1.6. The sliding support 22.1 is attached to a lower end of the corresponding lever mechanism 24 and, in a similar manner, another roller 22 (not shown) and another sliding support 22.1 (not shown) are provided on the side wall 1.8.

Referring to the FIGS. 1 and 2, a pair of front upper guide rollers 7 are rotatably mounted on associated axles 7.2 at opposite front corners of the upper wall 1.4 by a pair of supports 7.1 attached to the wall 1.4 and extending upwardly therefrom. A pair of rear upper guide rollers 8 are rotatably mounted on associated axles 8.2 at opposite rear corners of the upper wall 1.4 by a pair of supports 8.1 in a similar manner. Furthermore, as shown in the FIG. 2, a front lower guide roller 9 is rotatably mounted on an associated axle 9.2 at the right front corner or the lower wall 1.5 by a support 9.1 attached to the wall 1.5 and extending downwardly therefrom. A rear lower guide roller 10 is rotatably mounted on an associated axle 10.2 at the right rear corner of the lower wall 1.5 by a support 10.1 in a similar manner. Although not shown, similar rollers are mounted at the left corners of the lower wall 1.5. The lower guide rollers 9 and 10, the roller axles 9.2 and 10.2 and the supports 9.1 and 10.1 are dimensioned so that, during the transverse displacement of the car 1, they carry the weight of the car plus the passenger load. The supports 9.1 and 10.1 furthermore possess an internal drive mechanism, which is illustrated in the FIGS. 7 and 8, for the horizontal moving of the car 1 toward both sides. The supports 9.1 and 10.1 also include an adjusting mechanism, which is illustrated in the FIGS. 7 and 8, which presses the lower guide rollers 9 and 10 onto rolling tracks with a defined force to serve as an additional friction wheel drive for the vertical movement of the car 1. The upper guide rollers 7 and 8 and their respective supports 7.1 and 8.1 are constructed as bearing blocks, because the guide rollers 7 and 8 need fulfill only a simple guide function. The rollers 7 and 9 are located in a plane spaced in front or the front wall 1.7 and the rollers 8 and 10 are located in a plane spaced behind the rear wall 1.3.

Figure 4:
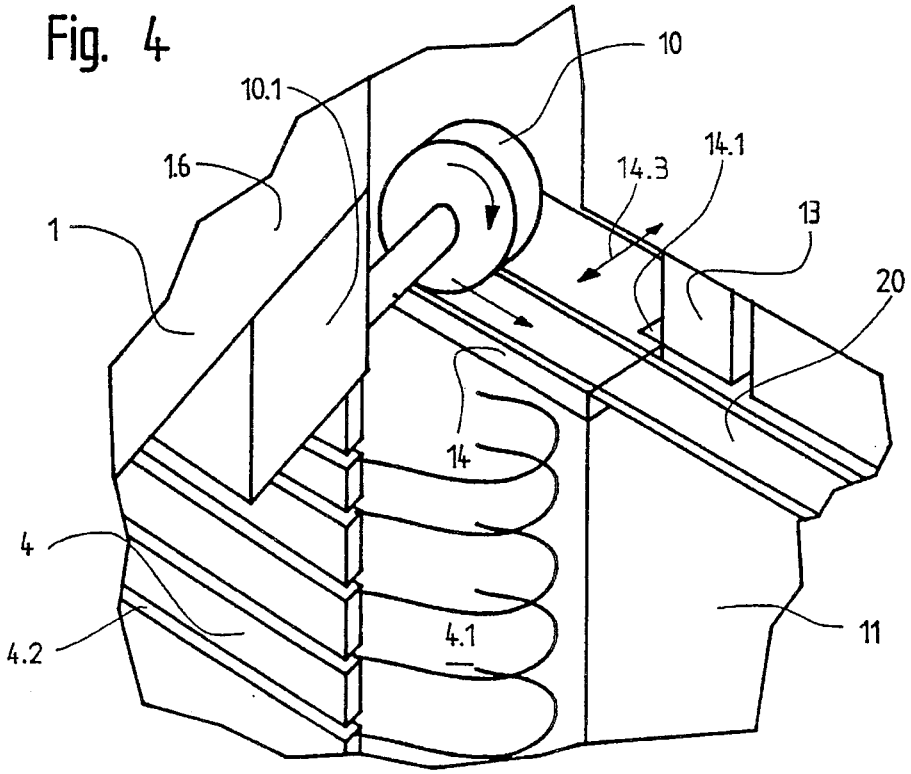
FIG. 4 is an enlarged fragmentary perspective view of the right rear lower corner of the elevator car and a section of the elevator shaft shown in the FIG. 1.
Figure 5:
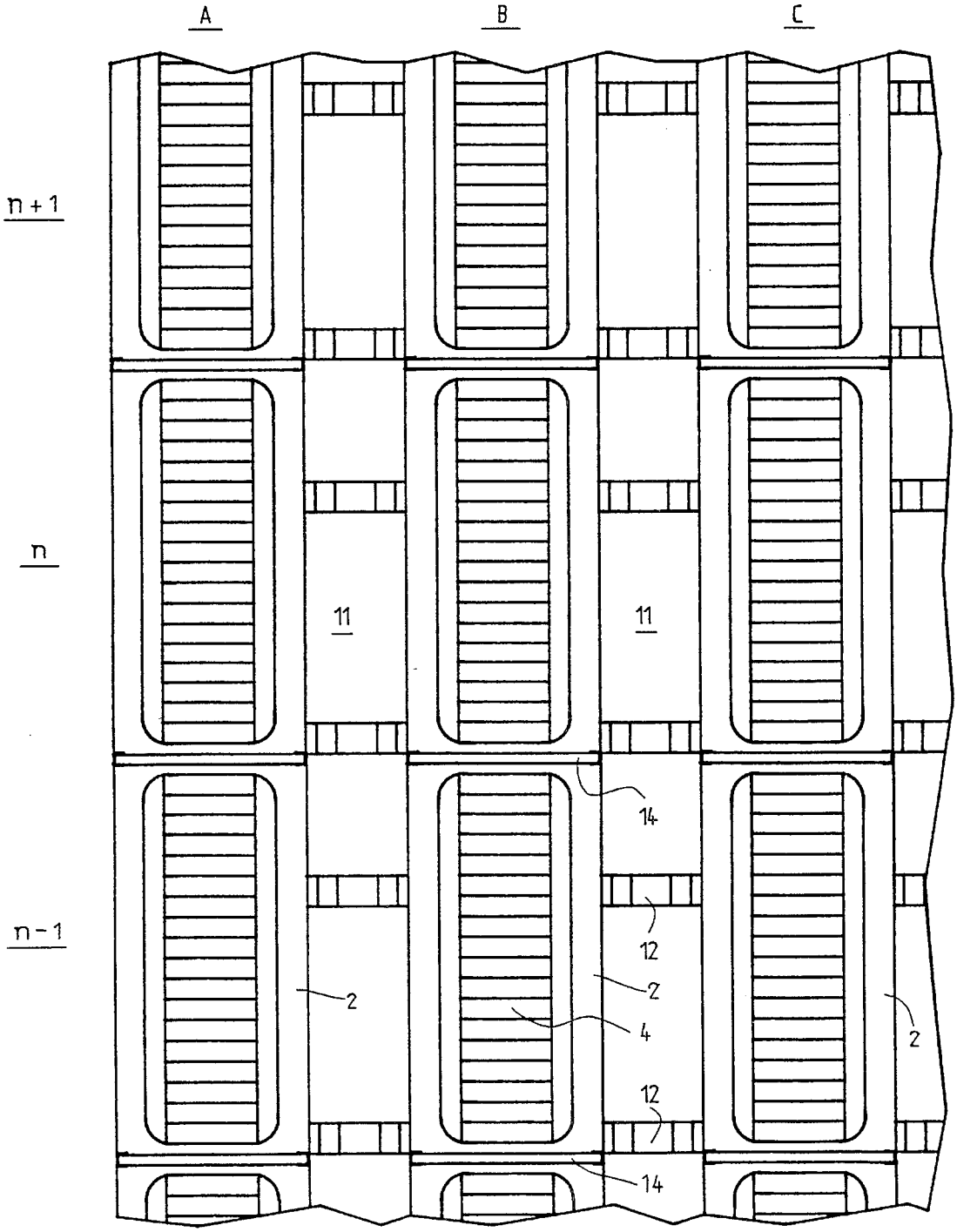
FIG. 5 is a fragmentary front elevation view of an elevator system in accordance with the present invention having several shafts and extending over several floors.

The FIG. 5 shows a portion of three adjacent vertical elevator shafts, shafts A, B and C, over a distance of four consecutive floors. As shown in the FIGS. 1 and 3 through 5, one of a plurality of vertically extending shaft wall strips 11 extends between each adjacent pair of the shaft rear walls 2 of the shafts A, B and C. The strip 11 protrudes from the plane of the rear walls 2 toward the plane of the front walls 3. Formed in the outer edges of the strip 11 are a pair of vertically extending continuous rolling tracks 11.1 and 11.2 which extend at fight angles to one another. The tracks 11.1 face toward the front of the shaft and accept the guide rollers 8 and 10. The tracks 11.2 adjacent the sides of a shaft face toward one another and accept the supporting rollers 6. A pair of continuous horizontal guide channels 12, each having a depth of at least two roller widths, are formed at each floor in the strips 11 and are spaced vertically the distance between the upper guide rollers 8 and the lower guide rollers 10 for vertically aligning with these guide rollers when the car entry opening 1.1 is aligned with the shaft door opening 3.1 at each floor. As shown in the FIGS. 1, 3 and 4, a pivotable intermediate piece 13 is positioned at each end of each of the guide channels 12. In the position shown, the pieces close the gaps, which are otherwise present due to the guide channels 12, in the rolling tracks 11.1 and 11.2. In order to open the guide channels 12 for a transverse displacement of the car 1, the intermediate pieces 13 are pivoted back through 90°, in the direction of arrows 13.2 shown in the FIG. 1 into a respective pocket 13.1 recessed in the rear wall of the guide channels 12. At each floor, a rear horizontal guide slide 14 is provided along the rear wall 2 at the level of the lower ones of the channels 12 adjacent to that floor. The slide 14 externals from side to side of the shaft and is selectively moveable by a pair of actuating devices 14.2 attached to the rear wall 2. The devices 14.2 selectively extend and retract the slide 14 horizontally in the direction of arrows 14.3 in lateral guide channels 14.1 positioned on opposite sides of the shaft adjacent to the edges of the linear motor stator 4. A similar front horizontal guide slide 15 is provided at each floor at the front wall 3 and is extended and retracted in the direction of arrows 15.3 by a pair of deflecting levers 15.1 coupled to separate actuating devices 15.2 attached to the front wall 3. As shown in the FIG. 3, the stator 4 is segmented with the segments defined by a plurality of horizontally extending grooves 4.2.

As shown in the FIG. 1, the structure of the front wall 3 is similar to that of the rear wall 2. A pair of vertically extending shaft wall strips 21 extend adjacent opposite side edges of the front wall 3 and protrude from the plane of the front wall 3 toward the plane of the rear wall 2. A vertically extending continuous rolling track 21.1 is formed at each outer edge of the strip 21 and the tracks on opposite sides of a shaft face each other for accepting the rollers 7 and 9. At each floor, a pair of horizontal guide channels 17 are formed in the strip 21 at the height of the channels 12. Pivotable angular intermediate pieces 16 are positioned at each end of each or the guide channels 17. In order to open the guide channels 17 for a transverse displacement of the car 1, the intermediate pieces 16 are each pivoted back through 90° in the direction of arrows 16.2 into respective pockets 16.1 recessed in the rear walls of the guide channels 17. In the position shown, the pieces 16 close the gaps otherwise present due to the horizontal guide channels 17 formed in the rolling tracks 21.1. The vertical heights of each of the horizontal guide channels 17 and 12 are somewhat greater than the diameters of the guide rollers 7, 8, 9 and 10 in order to ensure a free passage in the channels.

Figure 3:
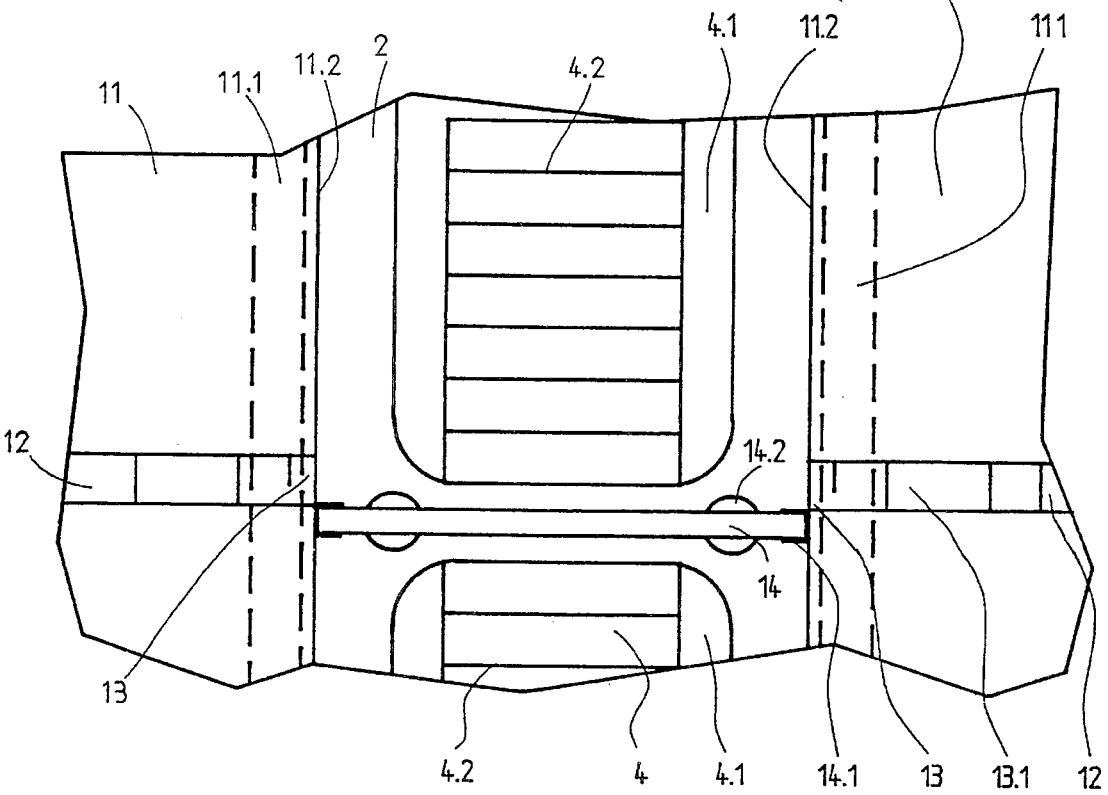
FIG. 3 is a fragmentary front elevation view of a section of the rear wall of the elevator shaft shown in the FIG. 1.

The FIG. 3 shows a detail of the shaft rear wall 2 at a floor level. It is evident that the linear motor stator 4 is interrupted at the height of the corresponding floor level. The horizontal guide slides 14 in the lateral guide channels 14.1 are disposed in these gaps between the stators 4. The tipper surface of the horizontal guide slide 14 is located at exactly the same height as the lower horizontal rolling surface of the guide channels 12 adjacent to the left and right ends of the guide slide 14 in order to enable a shock-free rolling of the guide rollers 10 during horizontal travel of the car 1. The pivotable intermediate pieces 13 are shown in the position required for normal vertical travel of the car 1.

Figure 7:
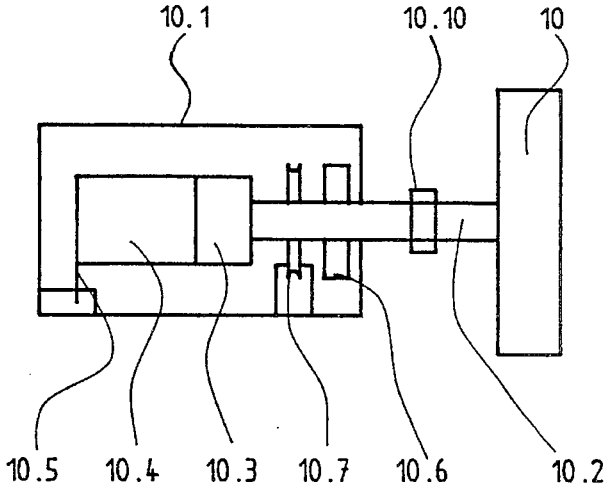
FIG. 7 is schematic representation of a friction wheel drive of the elevator car shown in the FIG. 1.
Figure 8:
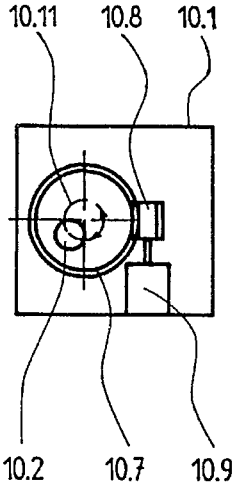
FIG. 8 is a schematic representation of the eccentric adjustment device of the friction wheel drive shown in the FIG. 7.

The FIGS. 7 and 8 show the details of the friction wheel drive and the contact pressure mechanism. Although only the drive for one of the rear lower guide rollers 10 is shown, the front lower guide rollers 9 are driven in a similar manner. A friction wheel drive housed in the support 10.1 includes a battery powered direct current electrical motor 10.4 coupled to rotate the axle 10.2 through a reduction gear 10.3. The motor 10.4 is provided with a torque stay 10.5 in the housing of the support 10.1. The axle 10.2 is has a bending force sensor 10.10 mounted thereon external to the support 10.1 and is guided by an eccentric bearing 10.6 in the support 10.1. As shown in the FIG. 8, a worm wheel 10.7 is eccentrically mounted on the axle 10.2 inside the support 10.1 and is driven by a servomotor 10.9 rotating a worm 10.8. Thus, the roller axle 10.2 can be moved such that its longitudinal axis defines a circular path 10.11. As explained below, the servomotor 10.9 is selectively actuated to rotate the roller 10 into and out of engagement with the slide 14.

Figure 6:
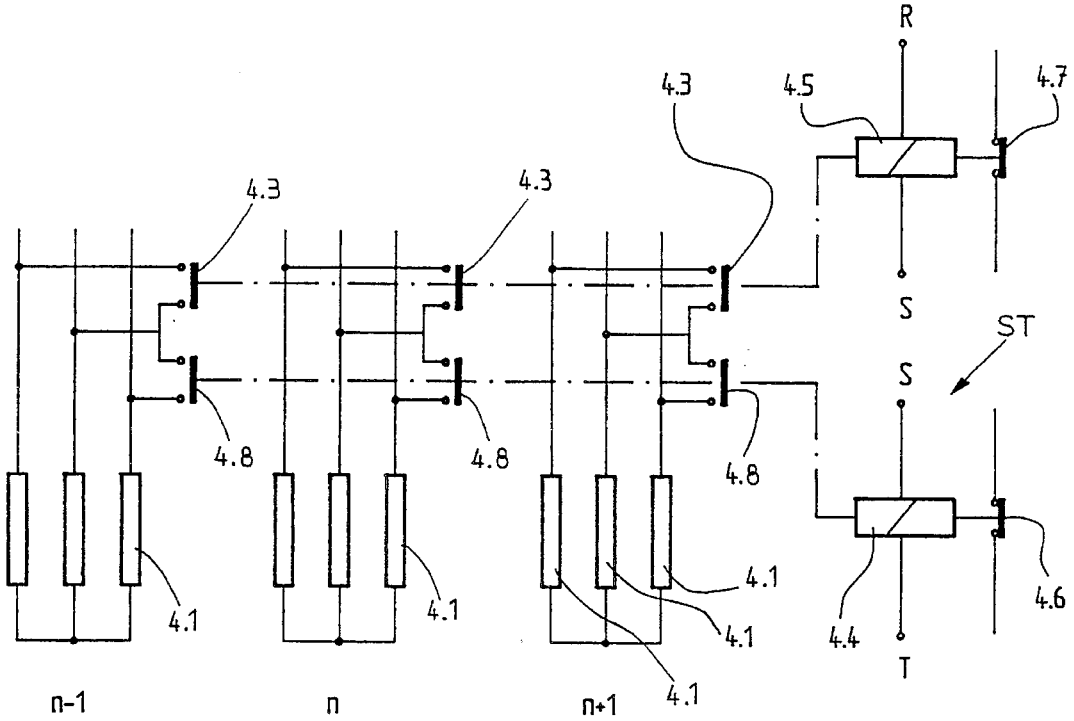
FIG. 6 is a schematic diagram of a switching circuit of an electrical brake for the elevator system shown in the FIG. 1.

The operation of the elevator system according to the present invention is described below with reference to the FIGS. 4, 5 and 6. By comparison with a cable suspended elevator, different functions can be carried out during the vertical travel of the car 1. Before the start a vertical travel up or down, the car 1 stands at a floor supported by the guide rollers 9 resting on the front slide 15 and the guide rollers 10 resting on the rear slide 14 which slides have been extended out into the shaft. Furthermore, all of the pivotable intermediate pieces, 13 at the rear and 16 at the front, have been pivoted out into the respective horizontal guide channels, 12 at the rear and 17 at the front, in order to form gapless vertical rolling surfaces for the guide rollers 7 and 9 in the rolling track 21.1, the guide rollers 8 and 10 in the rolling track 11.2 and the supporting rollers 6 and 22 in the rolling track 11.1. Upon receipt of a travel command, the load on the horizontal guide slides 14 and 15 are relieved by a slight raising of the car 1 and then the slides are retracted into their respective stored positions. The raising and the subsequent travel of the car 1 are initiated by switching on the combined drive which consists of the battery powered friction wheel drive on the car and the mains power supply connected linear motor drive. The linear motor drive includes the stators 4 as a first portion on the shaft rear wall and the permanent magnets 5 as a second portion located in the car rear wall 1.3 and functioning as a "linear rotor" component of the linear drive. The role of the friction wheel drive is that, in the presence of a travel command, it compensates for a portion of the car weight through production of a constant torque in the same direction of rotation as the guide rollers 8, whereby the driving power to be generated by the linear drive can be reduced by this amount. The friction wheel drive thus fulfills, herein in reduced form, the function of the counterweight in a cable suspended elevator.

The traveling field generated in the linear motor stator 4 in a downward or an upward direction pulls the permanent magnet 5 out of the cavity 5.1 at the car rear wall 1.3 to the abutments 5.3 to form a working air gap 26 (FIG. 1) between the permanent magnet 5 and the linear motor stator 4, which gap is necessary for linear force transmission. The high magnetic attraction forces, which also arise horizontally during the linear force transmission, are absorbed by the supporting rollers 6 and 22 mounted at the car side walls 1.6 and 1.8. The supporting rollers 6 and 22 are moved by the actuating devices 23 and the lever mechanisms 24 into a predetermined horizontal position, whereby the working air gap 26 is maintained between the permanent magnets 5 and the linear motor stator 4. A traveling field, which is controlled in frequency and amplitude and generated by a conventional drive feed and control (not shown), in the linear motor stator 4 now moves the car 1 in the desired direction up or down to a desired destination floor. Having arrived at the desired destination floor, the car 1, moving for example downwardly from above, is stopped electrically about one centimeter before the floor level, the horizontal guide slides 14 at the rear and 15 at the front are extended into the shaft at this floor and the car I is lowered thereon, whereupon the linear and friction wheel drives are switched off. The setting-down onto the extended horizontal guide slides 14 and 15 upon the stopping at the destination floor before the opening of the car door assures that the car 1 will not travel downward from that position. Of course, a conventional door drive is also provided, which performs the usual functions, but is neither described nor drawn for clarification of the subject of the invention. At the end of an upward travel, the car travels beyond the destination floor, for example by one centimeter, in order that the corresponding horizontal guide slides 14 at the rear and 15 at the front can again be extended below the lower guide rollers 9 and 10 and the car 1 lowered down thereupon and the drives switched off.

During the vertical travels, the linear motor stators 4 are fed and controlled zone by zone so that only those linear motor stators 4 which are then situated directly behind the traveling car 1 are switched on. The division of the linear motor stators 4 between floors is evident in the FIGS. 3 and 5. When the car 1 is moving over the gaps between the floors, the two adjacent linear motor stators 4 are switched on during the transition time. This division of the motor stators 4 enables more than one car to travel in each shaft and also saves electrical energy, in particular, reactive energy. It is thus possible to have several cars move one behind the other in the same direction at the spacing of two floors, because it is envisaged to use the described system for buildings with, for example, fifty or more stories. For this reason, the possibility of an electrical mains failure during vertical travel must be considered. The FIG. 6 shows a circuit which responds in the event of a mains failure. A phase-checking protection coil 4.4 is connected between phases S and T of the mains power supply and a phase-checking protection coil 4.5 is connected between phases R and S of the mains power supply. Associated with the coil 4.4 is an auxiliary contact 4.6 to form a phase-checking relay ST. Associated with the coil 4.5 is an auxiliary contact 4.7 to form a phase-checking relay RS. Mains contacts 4.8 are actuated by the phase-checking relay ST and mains contacts 4.3 are actuated by the phase-checking relay RS. The main contacts are respectively associated with each of three power feed lines connected to the stator windings 4.1 and can short-circuit these lines in the case of a mains failure. In the FIG. 6, the mains voltage is present and the mains contacts 4.8 and 4.3 are open. The number of main contacts associated with the phase-checking relays RS and ST determines the corresponding number of stator windings 4.1 per phase-checking relay which can be short-circuited in the case of a mains failure. The number of phase-checking relays per shaft is thus dependent on the total number of floors and the number of main contacts per phase-checking relay. In the example shown in the FIG. 6, there are three intermediate floors n–1, n and n+1 (shown in the FIG. 5) and the windings 4.1 of the corresponding linear motor sharers 4 can all be short-circuited in the case of a mains failure.

When the mains voltage fails during a vertical travel, the permanent magnets 5 on the immediately falling car 1 move past the windings 4.1 and generate a voltage and a current in the now short-circuited windings 4.1 which exerts a strong braking effect on the falling car 1. Thus, the car 1 travels downwardly at a moderate speed in the case of a mains failure, and the battery powered friction wheel drive continues to effect a further speed reduction through the rollers 9 and 10. Further, a not illustrated mechanical braking mechanism can be provided for stopping the falling car at a floor for the evacuation of passengers. The auxiliary contacts 4.6 and 4.7 function as reporting devices for any desired recording and/or controlling equipment. The above described system and the circuit shown in the FIGS. 6 and 7 thus function as an automatic electrical brake independent of the mains for cableless elevator cars. It must be noted in this context that the permanent magnets also always remain in the extended position during a mains failure, because the small working air gap 26 between the stator laminations of the linear motor stator 4 and the outer pole area of the permanent magnets 5 still assures sufficient magnetic attraction force to overcome the return springs 5.2.

For an horizontal travel of the car 1, the following conditions and functions must be fulfilled in the described sequence:

a. the selected car 1 is resting on the extended guide slides 14 at the rear and 15 at the front at a selected floor in a first shaft;

b. the car door and the adjacent shaft door are closed;

c. the friction wheel drive in the supports 9.1 and 10.1 is switched off;

d. the contact pressure of the guide rollers 9 and 10 is removed from the rolling tracks 21.1 and 11.2 respectively by actuating the servomotors in the supports 9.1 and 10.1 respectively;

e. the pivotable intermediate pieces 13 at the rear and 16 at the front are pivoted back into the recesses 13.1 and 16.1 respectively in the horizontal guide channels 12 and 17 respectively adjacent the car location on the side towards a second shaft to which the car is to travel;

f. the permanent magnets 5 are released and retracted by the springs 5.2 into the cavity 5.1 in the car rear wall 1.3 by a brief direct current feed into the winding 4.1 of the linear motor stator 4 behind the car to generate a like pole with the permanent magnets 5; and g. the supporting rollers 6 and 22 on both car sides 1.6 and 1.8 are retracted from the rolling tracks 11.1 by the actuating devices 23 and the lever mechanisms 24.

The FIG. 4 shows a detail view of the guide roller 10 attached to the lower right rear comer of the car 1 before a horizontal travel of the car towards the right. A guide groove 20, which is contoured to the crown profile of the guide roller 10, is formed in the upper surfaces of the horizontal guide slide 14 and the lower wall of the horizontal guide channel 12. The guide groove 20 horizontally guides the car 1 to prevent movement toward the front or rear of the shalt. It is important that the supporting rollers 6 and 22 be retracted only after the release of the permanent magnets 5, because the car 1 would otherwise be drawn with great force toward the linear motor stator 4. When all preparatory conditions and functions are fulfilled according to the above described sequence, horizontal travel to the adjacent, or if necessary to a more remote travel shaft, can take place. For this purpose, the friction wheel drive in the four lower supports 9.1 and 10.1 is switched on for horizontal travel in the selected direction and at a predetermined horizontal speed matched to the conditions. The upper guide rollers 8 at the rear and 7 at the front run without contact through the upper horizontal guide channels 12 at the rear and 17 at the front. Not illustrated position sensors in the destination shaft terminate the horizontal travel and the functions for the continuation of the travel in a vertical direction can take place, unless a stopping command for the new horizontal location is present requiring a door-opening and door-closing function for the boarding and/or alighting of persons. For the now following vertical travel, the following conditions and functions must be fulfilled in the described sequence:

a. the horizontal guide slides 14 at the rear and 15 at the front are retracted at the selected floor in the first shaft;

b. the pivotable intermediate pieces 13 at the rear and 16 at the front are pivoted out and latched at the selected floor in the first shaft;

c. the car door and the adjacent shaft door are closed;

d. the pivotable intermediate pieces 13 at the rear and 16 at the front are pivoted out and latched at the floor in the second shaft;

e. the supporting rollers 6 and 22 are extended into the position for vertical travel;

f. the guide rollers 9 and 10 are pressed against the corresponding rolling tracks in the second shaft;

g. the friction wheel drive is switched on;

h. the linear motor stator 4 behind the car 1 is switched on to generate a traveling field for the desired direction of travel;

i. the permanent magnets 5 are extended into the operative position;

j. the load on the horizontal guide slides 14 at the rear and 15 at the front is relieved by a slight raising of the car 1;

k. the horizontal guide slides 14 and 16 are retracted; and l. the vertical travel in the desired direction of travel is initiated.

The sequence of the above described functions is assured by a not shown hierarchically divided, partially decentralized control with internal monitoring and safety functions executed in microprocessor technology. The contact pressure mechanism in the supports 9.1 and 10.1, in the form of the motorized eccentric bearing adjustment, permits a fine leveling on stopping at a floor and a load measurement can be undertaken with the bending force sensor in combination with a corresponding conventional evaluation.

A building equipped with the elevator system according to the present invention can have a plurality of travel shafts, the number of which is reduced with increasing height and in which passenger cars and special cars move in vertical and horizontal directions, wherein the number of cars is a multiple of the number of travel shafts. Several of the cars 1 can travel one behind the other at the same time in the same travel shaft. Floors blocked for through travel by a following car for any reason can be bypassed. Decentralized car buffers can be formed with additional side shafts at any desired floors. The batteries for the friction wheel drive are connected at the floors with a central charging station and are recharged at each stop of the car.

The practical execution of the system can depart in detail from the shown example. Prefabricated mountable units, which are equipped with all mechanical and electrical components, can also be used as the horizontal guide channels 12 and 17. The cars 1 can carry spacing sensors on the bottom side 1.5 and on the upper side 1.4 which continuously supply information to the control about distances from and speed differences of cars below and above the car 1. The instantaneous states of all horizontal guide slides 14 and 15 can be detected by sensors and reported to the control just as the states of the pivotable intermediate pieces 13 and 16 can be. The control of the friction wheel drive in the supports 9.1 and 10.1, as well as that of the supporting rollers 6 and 22, can be taken over by a car control. Special cars, which in the case of non-use are disposed in a car depot, can be used for special transports of any kind. They can in case of need be commanded away and moved to the destination place. In a further alternative embodiment, the supporting rollers 6 and 22 can be located at the height of the guide rollers 8 and 10 and no longer need to be retracted for the horizontal travel, whereby the actuating devices 23 and the lever mechanisms 24 can be eliminated. For additional friction wheel drive during vertical travel, the supporting rollers 6 and 22 could additionally or exclusively be equipped with a drive, whereby the only contact pressure mechanism required would be provided by the magnetic attraction forces. A frequency-regulated polyphase alternating current motor can provided as a drive motor for each of the friction wheel drives when the energy feed is provided by current-collecting lines instead of an on-board battery.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A cableless elevator system for high buildings having elevator cars moving in and between at least two vertically extending elevator shafts comprising:

an elevator car having a friction drive means attached thereto for moving along a vertical travel path in an elevator shaft and along an horizontal travel path extending from the elevator shaft;

a linear drive having a first portion mounted on said elevator car and a second portion mounted in the elevator shaft for moving said elevator car along the vertical travel path; and horizontal guide means extending from the elevator shaft and forming the horizontal travel path for said elevator car, said horizontal guide means including pivotable intermediate pieces for selectively closing and opening gaps in the elevator shaft at the horizontal travel path along the vertical travel path for said elevator car.

2. The elevator system according to claim 1 wherein said horizontal guide means includes lower front and rear guide channels positioned at a level of a floor served by the elevator car in the elevator shaft and upper front and rear guide channels spaced above said lower front and rear guide channels.

3. The elevator system according to claim 1 wherein said first portion of said linear drive includes a plurality of linear motor stators mounted on a rear wall of the elevator shaft extending past several floors served by the elevator car in the elevator shaft, said stators being spaced apart between the floors, and including rear horizontal guide slides selectively extendable from the rear wall of the elevator shaft between the floors into the vertical path of travel of said elevator car in the elevator shaft.

4. The elevator system according to claim 3 including front horizontal guide slides extendable from a front wall of the elevator shaft between the floors into the vertical path of travel of said elevator car in the elevator shaft.

5. The elevator system according to claim 1 wherein said friction drive means includes front and rear tapper guide rollers mounted on an upper wall of said elevator car, front and rear lower guide rollers mounted on a lower wall of said elevator car and upper and lower support rollers mounted on side walls of said elevator car for engaging rolling tracks formed in the elevator shaft during the vertical travel of said elevator car, and actuating means attached to said elevator car and connected to said support rollers for selectively moving said support rollers into and out of engagement with corresponding ones of said rolling tracks.

6. The elevator system according to claim 5 including a plurality of supports attached to said lower wall of said elevator car and an associated one of a plurality of roller axles extending from each of said supports and wherein said lower front and rear guide rollers each are rotatably mounted on an associated one of said roller axles extending from an associated one of said supports attached to said lower wall of said elevator car, each said support including a direct current motor driving said associated roller axle coupled through a reduction gear.

7. The elevator system according to claim 6 wherein each said support includes an eccentric bearing in which said associated roller axle is mounted, a worm wheel attached to said associated roller axle, a worm engaging said worm wheel and a servomotor driving said worm whereby said servomotor is selectively actuated to move said guide roller attached to said associated axle to increase and decrease contact pressure between said guide roller and a corresponding one of said rolling tracks and to level said elevator car at a floor served by said elevator car.

8. The elevator system according to claim 6 including a bending force sensor mounted on at least one of said roller axles for measuring a contact pressure between said guide roller mounted on said one roller axle and a corresponding one of said rolling tracks and for measuring a car loading at said one roller axle.

9. The elevator system according to claim 6 wherein said direct current motor is battery powered.

10. The elevator system according to claim 1 wherein said first portion of said linear drive includes a plurality of permanent magnets retracted by springs into a cavity formed in a rear wall of said elevator car, said magnets being slidably extendable from said cavity against abutments attached to said elevator car, and said second portion of said linear drive includes a plurality of linear motor stators attached to a rear wall of the elevator shaft.

11. The elevator system according to claim 10 wherein said linear motor stators have windings and including selectively actuatable circuit means for short-circuiting said windings in response to a failure of a main power supply connected to said windings for electrically braking said elevator car in cooperation with said magnets.

12. The elevator system according to claim 11 wherein said circuit means includes a phase-checking relay connected to the main power supply and an electrical contact connected across one of said windings, said relay maintaining said contact open in response to the main power supply providing electrical power and closing said contact in response to a failure of the main power supply.

13. A cableless elevator system for high buildings having elevator cars moving in and between at least two vertically extending elevator shafts comprising:

an elevator car having a friction drive means attached thereto for moving along a vertical travel path in an elevator shaft and along an horizontal travel path extending from the elevator shaft;

a linear drive having a first portion mounted on said elevator car and a second portion mounted in the elevator shaft for moving said elevator car along the vertical travel path; and horizontal guide means extending from the elevator shaft and forming the horizontal travel path for said elevator car, said horizontal guide means including lower front and rear guide channels positioned at a level of a floor served by the elevator car and upper front and rear guide channels spaced above said lower front and rear guide channels, each said guide channel having a pivotable intermediate piece for selectively closing and opening gaps in the elevator shaft along the vertical travel path for said elevator car.

14. The elevator system according to claim 13 wherein said second portion of said linear drive includes a plurality of linear motor stators mounted on a rear wall of the elevator shaft extending past several floors served by the elevator car, said stators being spaced apart between the floors, and including rear horizontal guide slides selectively extendable from the rear wall of the elevator shaft between the floors into the vertical path of travel of said elevator car in the elevator shaft and front horizontal guide slides extendable from a front wall of the elevator shaft between the floors into the vertical path of travel of said elevator car in the elevator shaft.

15. The elevator system according to claim 13 wherein said friction drive means includes front and rear upper guide rollers mounted on an upper wall of said elevator car, front and rear lower guide rollers mounted on a lower wall of said elevator car and upper and lower support rollers mounted on side walls of said car for engaging rolling tracks formed in the elevator shaft during the vertical travel of said elevator car, and actuating means attached to said elevator car and connected to said support rollers for selectively moving said support rollers into and out of engagement with corresponding ones of said rolling tracks.

16. The elevator system according to claim 15 wherein said lower front and rear guide rollers each are rotatably mounted on an associated roller axle extending from an associated support attached to said lower wall of said elevator car, each said support including a direct current motor driving said associated roller axle coupled through a reduction gear, an eccentric bearing in which said associated roller axle is mounted, a worm wheel attached to said associated axle, a worm engaging said worm wheel and a servomotor driving said worm whereby said servomotor is selectively actuated to move said guide roller attached to said associated roller axle to increase and decrease contact pressure between said guide roller and a corresponding one of said rolling tracks and to level said elevator car at a floor served by said elevator car.

17. The elevator system according to claim 13 wherein said first portion of said linear drive includes a plurality of permanent magnets retracted by springs into a cavity formed in a rear wall of said elevator car, said magnets being slidably extendable from said cavity against abutments attached to said elevator car, and said second portion of said linear drive includes a plurality of linear motor stators attached to a rear wall of the elevator shaft.

18. The elevator system according to claim 17 wherein said linear motor stators have windings and including selectively actuatable circuit means for short-circuiting said windings in response to a failure of a main power supply connected to said windings for electrically braking said elevator car in cooperation with said magnets.

19. A cableless elevator system for high buildings having elevator cars moving in and between at least two vertically extending elevator shafts comprising:

an elevator car having a friction drive means attached thereto for moving along a vertical travel path in an elevator shaft and along an horizontal travel path extending from the elevator shaft, said friction drive means including front and rear upper guide rollers mounted on an upper wall of said elevator car, front and rear lower guide rollers mounted on a lower wall of said elevator car and upper and lower support rollers mounted on side walls of said car for engaging rolling tracks formed in the elevator shaft during the vertical travel of said elevator car, and actuating means attached to said elevator car and connected to said support rollers for selectively moving said support rollers into and out of engagement with corresponding ones of said rolling tracks;

a linear drive having a first portion mounted on said elevator car and a second portion mounted in the elevator shaft for moving said elevator car along the vertical travel path; and horizontal guide means extending from the elevator shaft and forming the horizontal travel path tier said elevator car, said horizontal guide means including lower front and rear guide channels positioned at a level of a floor served by the elevator car and upper front and rear guide channels spaced above said lower front and rear guide channels, each said guide channel having a pivotable intermediate piece for selectively closing and opening gaps in the elevator shaft along the vertical travel path for said elevator car.

* * * * *